United States Patent [19]

Miron

[11] Patent Number: 4,890,870

[45] Date of Patent: Jan. 2, 1990

[54] MORTISE LOCK ASSEMBLY WITH AUTOMATIC DEAD BOLT AND INCREMENTAL STOP

[75] Inventor: William L. Miron, Bloomfield Hills, Mich.

[73] Assignee: Computerized Security Systems, Inc., Troy, Mich.

[21] Appl. No.: 182,919

[22] Filed: Apr. 18, 1988

[51] Int. Cl.[4] ..... E05C 1/16

[52] U.S. Cl. ..... 292/333

[58] Field of Search ..... 292/333, 335, 336, 150, 292/332

[56] References Cited

U.S. PATENT DOCUMENTS

| | | | |
|---|---|---|---|
| 289,542 | 12/1883 | Krings | 70/151 |
| 416,181 | 12/1889 | O'Keefe | 70/151 |
| 1,808,219 | 6/1931 | Hall | 292/333 |
| 2,519,808 | 12/1950 | Young et al. | 70/151 |
| 2,908,523 | 10/1959 | Foster | 292/333 |
| 4,765,663 | 8/1988 | Raymond et al. | 292/333 |

*Primary Examiner*—Richard E. Moore

*Attorney, Agent, or Firm*—Reising, Ethington, Barnard, Perry & Milton

[57] ABSTRACT

A mortise lock assembly disposed within a housing for mounting in a door. The assembly includes a latch bolt and a dead bolt, both of which are movably mounted within the housing and reciprocal between an extended position cut out of the housing and a retracted position within the housing. The assembly also includes latch bolt and dead bolt biasing mechanism for continuously biasing the latch bolt and dead bolt to their extended positions. The assembly further includes a trigger movably mounted within the housing and a dead bolt stop element movable between a dead bolt engaged position and a released position for restraining the dead bolt in the retracted position against the biasing force of the dead bolt biasing mechanism. The trigger moves the dead bolt stop element from the dead bolt engaged position to a dead bolt release position allowing the dead bolt to be moved automatically to the extended position by the biasing force of the dead bolt biasing mechanism when the trigger senses the strike plate on the door jamb as the door is closed.

11 Claims, 3 Drawing Sheets

MORTISE LOCK ASSEMBLY WITH AUTOMATIC DEAD BOLT AND INCREMENTAL STOP

FIELD OF THE INVENTION

This invention relates to a mortise lock assembly that includes a dead bolt which is automatically thrown to the extended and locked position when the door is closed; more particularly, it relates to a mortise lock with an improved trigger means for sensing a strike plate when the door is closed and thereby releasing the dead bolt so as to be moved automatically to its extended position.

BACKGROUND OF THE INVENTION

Mortise locks which employ automatic dead bolts are often used in hotels and the like so that a guest need not independently and manually throw the dead bolt. The automatic dead bolt feature also increases the security of the guest in the room. There is presently a need in the industry for a mortise lock with an automatic dead bolt feature which operates smoothly and efficiently with a maximum of simplicity.

As previously mentioned, it is known in the art to have a mortise lock which employs an automatic dead bolt. For example, such a mortise lock is disclosed in Krings patent 298,542 granted Dec. 4, 1883. In addition, various types of triggers have been employed in the prior art for sensing a strike plate when a door is closed and thereby releasing the dead bolt so it may be moved to its extended position. Some examples of prior art triggers may be found in the Krings '542 patent as mentioned above and also in the O'Keefe patent 416,181 granted Dec. 3, 1889 and the Young et al patent 2,519,808 granted Dec. 22, 1950. Finally, it is also known to employ a ratcheted stop means in conjunction with the trigger for the automatic dead bolt as disclosed in the Raymond et al application, U.S. Ser. No. 342,144 entitled "Spring Loaded Dead Bolt Assembly", now abandoned.

Mortise lock assemblies which employ automatic dead bolts in the prior art often have problems with retaining the dead bolt in its retracted position and also with inadvertent releasing of the dead bolt which causes the dead bolt to fly out to its extended position before the door is closed.

SUMMARY OF THE INVENTION

The subject invention relates to a mortise lock with an automatic dead bolt feature and an improved trigger means and stop means.

In accordance with the invention, there is a combined dead bolt and latch bolt disposed within a housing with the dead bolt biased to its extended position such that when the door is closed the dead bolt will be automatically thrown to its extended position. A unique trigger is employed for sensing the strike plate and releasing the dead bolt from its retracted position. The assembly includes a latch bolt movably mounted within the housing and reciprocal between an extended position out of the housing and a retracted position within the housing. Further, the latch bolt is continuously biased to an extended position. A dead bolt is movably mounted within the housing and reciprocal between an extended position out of the housing and a retracted position within the housing. A dead bolt biasing means is employed for continuously biasing the dead bolt to the extended position. A trigger means is movably mounted within the housing and reciprocal between an extended position out of the housing and a retracted position within the housing for sensing a strike plate when the door is closed. A dead bolt stop means is also included and is movable between a dead bolt engaged position and a release position for restraining the dead bolt in the retracted position against the biasing force of the dead bolt biasing means. The trigger means operatively moves the dead bolt stop means from the dead bolt engaged position to the dead bolt release position allowing the dead bolt to be moved automatically to the extended position by the biasing force of the dead bolt biasing means when the trigger means is moved from an extended position to the retracted position within the housing. The stop means includes a stop element and a cam link operatively connected to the stop element and rotatable about a pivot point spaced from the connection to the stop element. The trigger means is adapted to operatively rotate the cam link about the pivot point to operatively move the stop element from the dead bolt engaged position to a dead bolt released position.

A more complete understanding of this invention may be obtained from the detailed description that follows taken with the accompanying drawings.

BEST MODE FOR CARRYING OUT THE INVENTION

Figure 2:
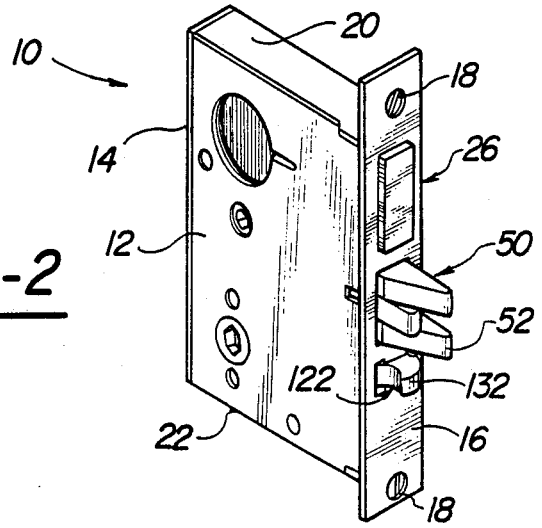
FIG. 2 is a perspective view of the mortise lock of the present invention.

A mortise lock assembly disposed within a housing for mounting on a door is generally shown at 10. As shown in FIG. 2, the housing includes a pair of opposing side plates 12, a back plate 14 extending between the side plates 12 at the rear of the housing and a front plate 16 extending between the side plates 12 and adapted to be mounted flush with the free end of the door by means of fasteners 18 or the like. The housing also includes a top plate 20 and a bottom plate 22. The plates 12, 14, 16, 20 and 22 of the housing are all positively fastened together by fasteners 24 but may be fastened in any other manner.

Figure 3:
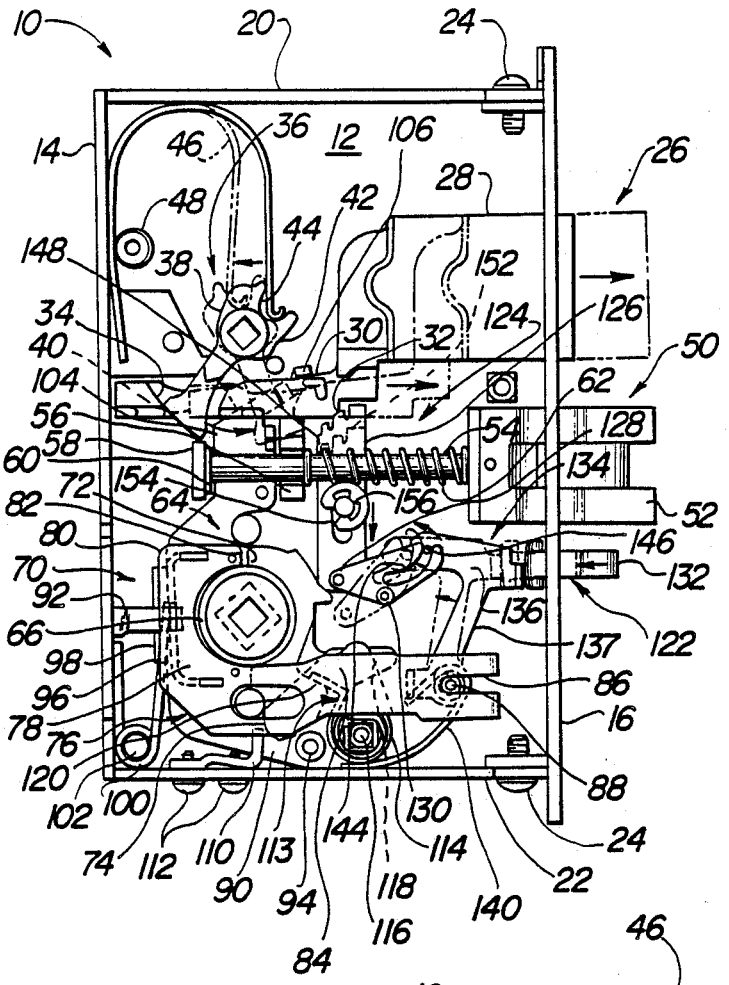
FIG. 3 is a side elevational view of the mortise lock of FIG. 1 showing the positions of the various elements of the mortise lock when the dead bolt is in its less than fully retracted position.
Figure 4:
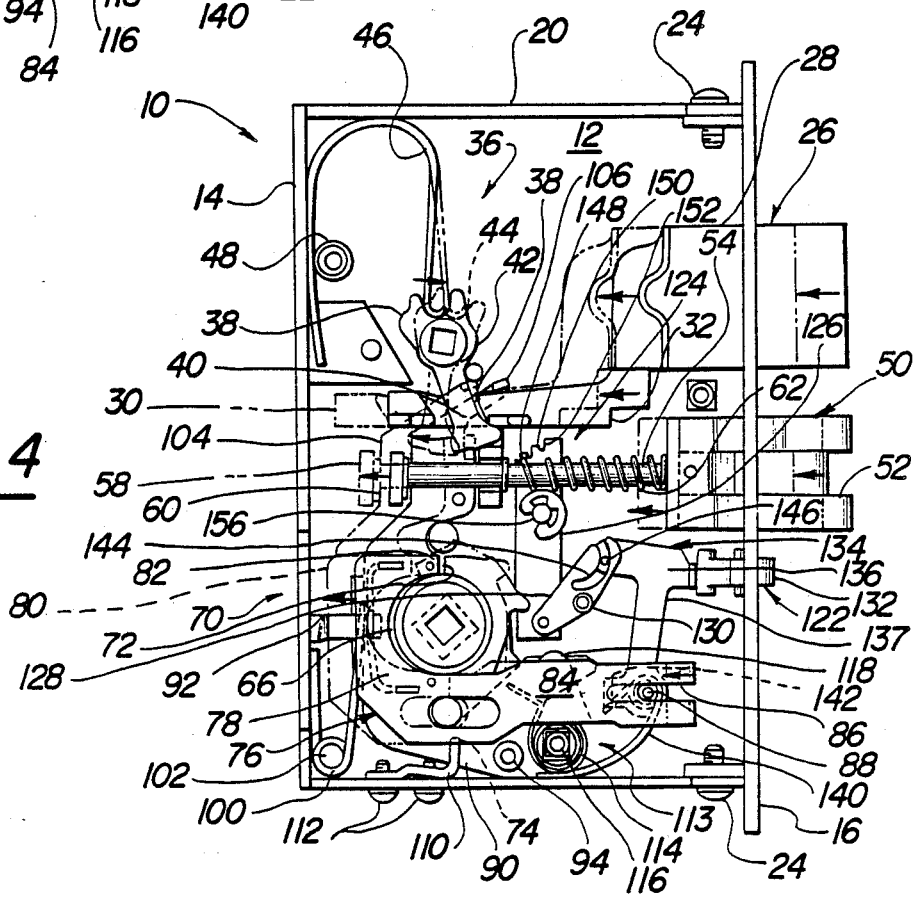
FIG. 4 is a side elevational view of the mortise lock of FIG. 1 showing the position of the various elements of the mortise lock when the dead bolt is in its fully extended position.

The assembly 10 includes a dead bolt, generally indicated at 26, movably mounted within the housing and reciprocal between an extended position out of the housing and a retracted position within the housing. The dead bolt 26 includes a rectangular block portion 28 which extends through an opening in the front plate 16 of the housing when the dead bolt is in the extended position. The block portion 28 is received in a notch disposed in an opposing strike plate opposite the housing in the door jamb. The dead bolt 26 includes a rearwardly extending offset dead bolt tail piece 30 presenting a flange 32 thereon and also including a slot 34 in the tail piece 30. A dead bolt biasing means, generally indicated at 36, is utilized to continuously bias the dead bolt 26 to the extended position to facilitate the automatic dead bolt feature of the mortise lock assembly 10 as will be described below. The dead bolt biasing means 36 includes a dead bolt turn piece 38 journaled on the housing at the side wall 12 and which includes an extending portion 40 extending from the head 42 of the turn piece 38 and disposed within the slot 34 on the tail piece 30 of the dead bolt 26 and a spring receiving depression 44 disposed on the head 42 and opposite the extending portion 40 for receiving a throw spring 46. The throw spring 46 is a horse shoe shaped spring which is disposed between the back plate 14 and a pin 48 fixedly secured to a side wall 12 on one side and which acts against the spring receiving depression 44 to continuously bias the dead bolt turn piece 38 in a counterclockwise direction thereby biasing the dead bolt 26 to its extended position through the action of the extending portion 40 on the slot 44 as shown in FIGS. 3 and 4.

The assembly 10 also includes a latch bolt, generally indicated at 50, movably mounted within the housing and reciprocal between an extended position out of the housing and a retracted position within the housing. The latch bolt 50 includes a reversible antifriction type latch 52, commonly known in the art, which extends through an opening in the front plate 16 of the housing when the latch bolt 50 is in its extended position. The latch 52 is received in a notch disposed in the opposing strike plate opposite the housing in the door jamb. The latch bolt 50 includes a tail piece 54 projecting rearwardly from the latch 52 away from the front plate 16 and through a U-shaped guide slot formed in a boss 56. The boss 56 is fixedly mounted to the housing at the side plate 12. The tail piece 54 includes a tail plate 58 disposed at the distal end of the tail piece 54 and forms an abutment surface 60 thereon. A latch bolt biasing means 62 is utilized for continuously biasing the latch bolt 50 to the extended position. The latch bolt biasing means comprises a compression spring 62 disposed about the cylindrical tail piece 54 which acts between the boss 56 and the latch 52 to continuously bias the dead bolt to the extended position.

The assembly 10 further includes a bolt retractor means, generally indicated at 64, for moving the latch bolt 50 and the dead bolt 26 to their retracted positions. The dead bolt retractor means 64 includes inner and outer hubs 66 and 68, respectively, journaled to the housing at a side wall 12 for independent rotation relative to each other within the housing. The retractor 64 is manually actuated by inner and outer lock shafts or spindles (not shown) which are rotatable by knobs or handles on the doors. The inner and outer hubs 66,68 are respectively mounted on the inner and outer spindles for rotation therewith. The dead bolt retractor means 64 also includes a hub lever means, generally indicated at 70, operatively connected to move the latch bolt 50 and the dead bolt 26 to their retracted positions in response to the rotational movement of either the inner or outer hubs, 66,68. More specifically, with reference to FIG. 5, the inner and outer hubs 66,68 each include a pair of plates which are sandwiched together. The hubs 66,68 are each journaled independently of one another to a separate opposing side wall 12. Both plates of the inner hub 66 rotate together and independently of each plate of the outer hub 68 as is commonly known in the art. The inner and outer hubs 66,68 each include a pair of diametrically opposed and radially disposed roll back surfaces 72,74, respectively.

The hub lever means 70 includes a retractor portion 76 operatively connected to the inner and outer hubs 66,68 and adapted for rectilinear movement in response to the rotation of the inner and outer hubs 66,68. The retractor portion 76 is generally L-shaped and includes a leg 78 to which is attached a semi-circular shoe portion 80 including radially disposed arcuate bearing surfaces 82 for bearing contact with roll back surfaces 72,74 of the inner and outer hubs 66,68, respectively. The shoe portion 80 is slidably supported on a fixed support pin 92. The support pin 92 is rectangular in shape and is fixedly mounted to the housing at the back plate 14. The support pin 92 extends from the back plate 14 toward the front plate 16 and through a rectangular aperture in the shoe portion 80 to facilitate the rectilinear movement of the retractor portion 76 in response to the rotational movement of the inner and outer hubs 66,68 through the bearing contact of the roll back surfaces 72,74 on the bearing surfaces 82 of the shoe portion 80.

The retractor portion 76 also includes a leg 84 extending beyond the hubs 66,68 and toward the front plate 16 of the housing. The leg 84 includes a slot 86 disposed at the distal end thereof. A guide pin 88 is fixedly secured to a side wall 12 of the housing and is disposed within the slot 86 to facilitate the rectilinear movement of the retractor portion 76 in response to the rotational movement of the inner and outer hubs 66,68 as described above.

Figure 5:
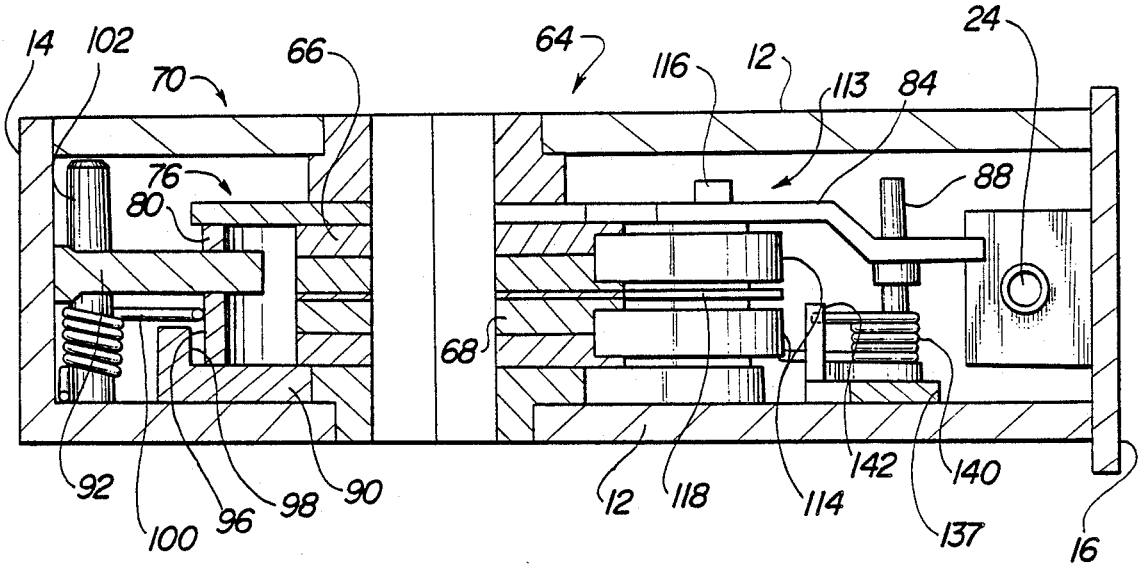
FIG. 5 is a cross-sectional view taken substantially along the line 5—5 of FIG. 1.

The hub lever means 70 also includes a lever portion 90 which is operatively connected to the retractor portion 76 and which is pivotal about a point at lever pin 94 in response to the rectilinear movement of the retractor portion 76 to move the latch bolt 50 and the dead bolt 26 to their retracted positions. In order to facilitate the transfer of the motion from the retractor portion 76 to the lever portion 90, the retractor portion 76 and the lever portion 90 include coacting bearing surfaces 96,98, respectively, which coact in response to the rectilinear movement of the retractor portion 76 to pivot the lever portion 90 about the pivot 94 in a counterclockwise direction to retract the dead bolt 26 and the latch bolt 50 as shown in FIG. 4. The bearing surface 96 of the retractor portion 76 consists of the side wall of the shoe portion 80. The bearing surface 98 of the lever portion 90 consists of an upwardly extending flange as best shown in FIG. 5. A coil spring 100 is employed to continuously bias the shoe portion 80 and thus the retractor portion 76 into engagement with the roll back surfaces 72,74 of the inner and outer hubs 66,68. The spring 100 is coiled about a post 102 fixedly secured to a side wall 12 and acts between the back plate 14 and the side wall of the shoe portion 80.

The hub lever portion 90 is also generally L-shaped with one leg extending from the pivot point 94 to the bearing surface 98 and the second leg extending upwardly toward the tail pieces of the latch bolt 50 and the dead bolt 26. The lever portion 90 includes a latch bolt retractor flange 104 operatively engaging the abutment surface 60 on the latch bolt tail piece 58. The lever portion 90 further includes a dead bolt retractor flange 106 extending outwardly from the lever portion 90 near the terminal end of its second leg for operatively engaging the extending portion 40 on the dead bolt turn piece 38. As the lever portion 90 is pivoted in response to the rectilinear movement of the retractor portion 76 as the inner hub 66 is rotated, the dead bolt retractor flange 106 will operatively engage the extended portion 40 on the dead bolt turn piece 38 to rotate the dead bolt turn piece 38 in a clockwise direction thereby retracting the dead bolt 26. Similarly, the latch bolt retractor flange 104 operatively engages the abutment surface 60 on the tail plate 58 to move the latch bolt tail piece 54 in a rearwardly direction thereby retracting the latch bolt 50. In this way, a "panic" feature is provided such that turning the knob or lever located on the inside of the door retracts both the latch bolt and the dead bolt simultaneously. The latch bolt and dead bolt may also be retracted simultaneously by turning the knob or lever located on the outside of the door when the outer spindle is not locked. The spindle may be locked, for example, by a locking mechanism as set forth in U.S. Ser. No. 040,739, filed Apr. 15, 1987, which is a continuation of U.S. Ser. No. 740,040, filed May 31, 1985, now abandoned, which is a continuation-in-part of U.S. Ser. No. 641,792, filed Aug. 17, 1984, now abandoned, which is a continuation-in-part of U.S. Ser. No. 594,471, filed March 28, 1984, and directed toward a microcomputer controlled locking system.

The bearing surface 98 of the lever portion 90 is biased into engagement with the bearing surface 96 of the retractor portion 76 by the action of the tail plate 58 on the latch bolt tail piece 54 as the latch 52 is biased to its extended position under the force of the compression spring 62. An outwardly extending stop 108 on the lever portion 90 is driven into abutting engagement with the boss 56 to limit the movement of the lever portion 90.

Figure 1:
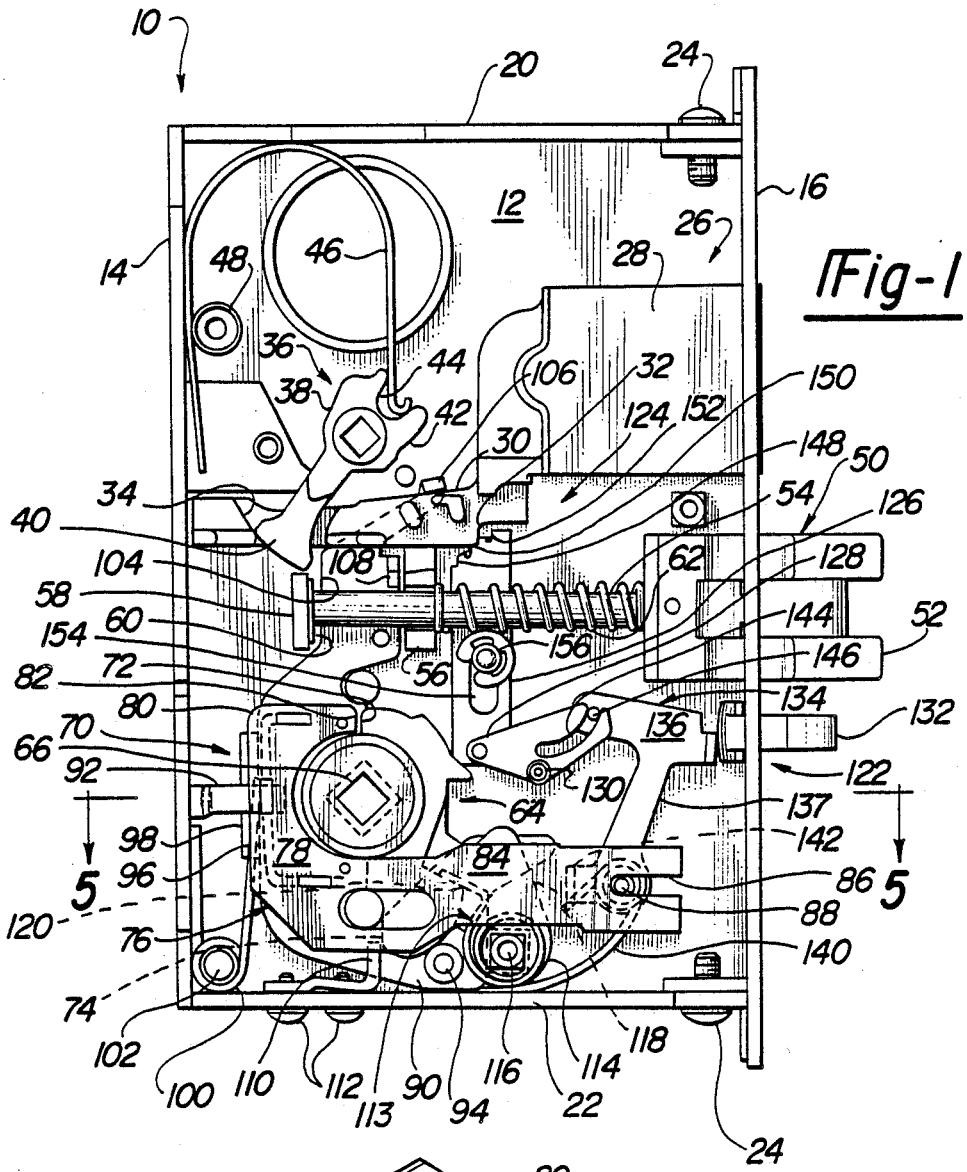
FIG. 1 is a side elevational view of the mortise lock shown in the housing with one of the sides of the housing removed.

With reference to FIGS. 1 and 5, the illustrative embodiment of the subject invention has a lever handle as opposed to the more common door knob to actuate the inner and outer hubs. Accordingly, a hub stop 110 is employed to allow rotation of the hub 66,68 in only one direction. In the preferred embodiment, the hub stop 110 includes an L-shaped member fixedly secured to the bottom plate 22 by fasteners 112 or the like and with one leg in rotationally limiting engagement with one set of the roll back surfaces 72,74 of the inner and outer hubs 66,68, respectively. This structure facilitates the use of a lever handle which conventionally is designed to rotate in only one direction. Conversely, the bolt retractor means 64 is easily adapted for use with door knobs by eliminating the hub stop 110 to allow rotation of the hubs in either the clockwise or counterclockwise direction. Because of the torque caused by the weight of the lever handle acting on the inner and outer hubs, a lever return means 113 is employed to bias the hubs 66,68 into engagement with the hub stop 110 to prevent "sagging" of the lever handle on the door. As shown in FIG. 5, the lever return means 113 includes a pair of coil springs 114 disposed about a support post 116 which is fixedly secured to a side wall 12. The coil springs are separated by a separation plate 118 which is also employed to separate the inner and outer hubs 66,68 to allow for smooth rotation of the hubs 66,68 with respect to one another and to prevent the pair of coil springs 114 from interfering with one another. Each coil spring 114 independently acts on a surface 120 presented by both the inner and outer hubs 66,68 to continuously bias one set of the pair of roll back surfaces 72,74 into engagement with the hub stop 110. In this way, when a lever is employed instead of a door knob, the inherent torque upon the inner and outer hubs 66,68 due to the weight of the lever may be counteracted to prevent the lever from sagging.

The mortise lock assembly 10 of the subject invention further includes trigger means 122 movably mounted within the housing and reciprocal between an extended position out of the housing and a retracted position within the housing for sensing the strike plate when the door is closed. A dead bolt stop means, generally indicated at 124, is movable between a dead bolt engaged position and a release position for restraining the dead bolt 26 in the retracted position against the biasing force of the dead bolt biasing means 36. The trigger means 122 operatively moves the dead bolt stop means 124 from the dead bolt engaged position to the dead bolt release position allowing the dead bolt 26 to be moved automatically to its extended position by the biasing force of the dead bolt biasing means 36 when the trigger means 122 is moved from its extended position to its retracted position within the housing when the trigger means 122 senses the strike plate on the door jamb as the door is closed.

More specifically, the stop means 124 includes a stop element 126 and a cam link 128 operatively connected to the stop element 126 and rotatable about a pivot pin 130. The pivot pin 130 is spaced from the connection of the cam link 128 to the stop element 126. The trigger means 122 is adapted to operatively rotate the cam link 128 about the pivot pin 130 to move the stop element 126 from its dead bolt engaged position to its dead bolt release position. The trigger means 122 includes an actuator 132 mounted within the housing and reciprocal between an extended position out of the housing through an aperture in the front plate 16 and a retracted position within the housing. The actuator 132 moves to its retracted position when sensing the strike plate when the door is closed. The trigger means 122 also includes a trigger hammer, generally indicated at 134, having a head portion 136 and a stem portion 137 and being pivotal about a pin 88 spaced from the head portion 136 and on the stem portion 137 in response to the actuator 132 moving to the retracted position. In this way, the cam link 128 is rotated about the pivot pin 130 to move the stop element 126 from its dead bolt engaged position to its release position. A hammer biasing means 140 is employed to bias the trigger hammer 134 into engagement with the actuator 132 to urge the actuator 132 to its extended position. The hammer biasing means is a coil spring 140 disposed about the guide pin 88 and acting between the bottom plate 22 of the housing and a lip 142 on the trigger hammer 134.

The cam link 128 includes a cam means 144 spaced from the pivot pin 130 and opposite to the connection to the stop element 126. The cam means defines a slot 144. The head portion 136 of the trigger hammer 134 includes a pin 146. The pin 146 is slidably disposed within the slot 144 for rotating the cam link 128 about the pivot pin 130 in response to the pivotal movement of the trigger hammer 134 as the actuator is moved to its retracted position.

The stop means 124 includes means for restraining the dead bolt 26 in a plurality of predetermined retracted positions with at least one of these positions being less than the dead bolt's fully retracted position. The means for restraining the dead bolt 26 include an incrementally stepped portion 148,150,152 disposed at one end of the stop element 126 for alternatively engaging the flange 32 on the dead bolt tail piece 30. The incrementally stepped portion 148,150,152 include a series of ascending stepped notches having an uppermost notch 152 disposed nearest to the front plate 16 of the housing to restrain the dead bolt 26 in its least retracted position. The incrementally stepped portion 148,150,152 also includes a lowermost notch 148 disposed farthest from the front plate 16 to restrain the dead bolt 26 in its fully retracted position. Intermediate stepped notches 150 are disposed between the uppermost notch 152 and the lowermost notch 148 for restraining the dead bolt 26 in a plurality of predetermined retracted positions depending upon the distance the dead bolt is retracted. The stop element 126 is adapted for rectilinear movement between the dead bolt engaging position and the released position in response to the rotation of the cam link 128 about the pivot pin 130. The stop element 126 of the preferred embodiment is a rectangular plate pivotally connected to the cam link 128 at one end thereof and with the incrementally stepped portion 148,150,152 disposed at the end opposite to the connection to the cam link 128. The stop element 126 includes a slot 154 disposed between the ascending stepped notches 148,150,152 and the connection to the cam link 128. A pin 156 is fixedly secured to a side wall 12 of the housing and extends through the slot to facilitate the rectilinear movement of the stop element 126.

In the illustrative embodiment, the latch bolt 50 is disposed between the dead bolt 26 and the bolt retractor means 64. The dead bolt 26 is disposed nearest to the top plate 20 and the bolt retractor means 64 being disposed nearest to the bottom plate 22. Further, the inner and outer hubs 66,68 are journaled in the housing at a point spaced from the front plate 16 of the housing with the trigger means 122 disposed between the inner and outer hubs 66,68 and the front plate 16 of the housing.

In its operative mode, a mortise lock assembly of the subject invention is disposed within a housing and mounted in a door. When the door is open, the dead bolt 26 is in its fully retracted position as shown in FIG. 1. When the door is closed, the latch 52 of the latch bolt 50 will be driven rearwardly to its retracted position upon coming into contact with the curved lip of a strike plate. Once the door is fully closed, the latch bolt 50 will automatically move to its extended position and into the notch disposed in the opposing strike plate under the force of the latch bolt biasing means 62. Similarly, the actuator 132 will be moved to its retracted position upon sensing the strike plate and pivot the trigger hammer 134 about its pivot pin 88 and rotate the cam link 128 about its pivot pin 130 to move the stop element 126 from its dead bolt engaged position to its released position. The dead bolt 26 will then be automatically driven from its retracted position to its extended position under the biasing force of the dead bolt biasing means 36. As such, the door will automatically be locked.

To open the door, an operator must turn a lever handle which in turn rotates the inner or outer hubs 66,68, depending on which side of the door the operator is located, in a counterclockwise direction as viewed in FIG. 1. For example, as the operator rotates the inner hub 66, the roll back surface 72 of the hub 66 operatively engages the bearing surface 82 of the shoe portion 80 resulting in rectilinear movement of the retractor portion 76. The bearing surface 96 of the retractor 76 coacts with the bearing surface 98 of the lever portion 90 to pivot the lever portion 90 counterclockwise about the pivot 94. The latch bolt retractor flange 104 operatively engages the abutment surface 60 on the latch bolt tail plate 58 to move the latch bolt tail piece 54 and thus the latch 52 in a rearwardly direction retracting the latch bolt 50. Simultaneously, the dead bolt retractor flange 106 rotates the dead bolt turn piece 38 in a clockwise direction thereby retracting the dead bolt 26.

If the gap between the front plate 16 of the housing and the strike plate is sufficiently large such that the dead bolt 26 need not be fully retracted to clear the notch in the strike plate and the operator does not fully retract the dead bolt 26 to open the door, the dead bolt 26 will not fly back to its extended position. This is because as soon as the door is opened, the hammer biasing means 140 biases the trigger hammer 134 into engagement with the actuator 132 moving the actuator to its extended position and moving at least one of the notches 148,150,152 of the incrementally stepped portion on the stop element 126 into engagement with the flange 32 on the dead bolt tail piece 30. The door may then be closed smoothly and the process repeated. The dead bolt will not interfere with the strike plate of the door jamb and prevent the door from closing.

Although the description of this invention has been given with reference to a particular embodiment, it is not to be construed in a limiting sense. Many variations and modifications will now occur to those skilled to those in the art. For a definition of the invention reference is made to the appended claims.

What is claimed is:

1. A mortise lock assembly disposed within a housing for mounting in a door opposite a strike plate on a door jamb, said assembly comprising:

a latch bolt movably mounted within said housing and reciprocal between an extended position out of said housing and a retracted position within said housing, latch bolt biasing means for continuously biasing said latch bolt to said extended position, a dead bolt movably mounted within said housing and reciprocal between an extended position out of said housing and a retracted position within said housing, dead bolt biasing means for continuously biasing said dead bolt to said extended position, a bolt retractor means for moving said latch bolt and said dead bolt to said retracted position, said bolt retractor means including inner and outer hubs journaled for independent rotation relative to each other within said housing and a hub lever means operatively adapted to move said latch bolt and said dead bolt to said retracted position in response to rotational movement of either of said inner and outer hubs, the improvement comprising:

trigger means movably mounted within said housing and reciprocal between an extended position out of said housing and retracted position within said housing for sensing a strike plate when the door is closed, a dead bolt stop means movable between a dead bolt engaged position and a release position for restraining said dead bolt in said retracted position against the biasing force of said dead bolt biasing means, said stop means including a stop element and a cam link operatively connected to said stop element and rotatable about a pivot point spaced from said connection to said stop element, said trigger means operatively moving said dead bolt stop means from said dead bolt engaged position to said dead bolt release position allowing said dead bolt to be moved automatically to said extended position by the biasing force of said dead bolt biasing means when said trigger means is moved from said extended position to said retracted position within said housing when the trigger means senses the strike plate on the door, said trigger means being adapted to operatively rotate said cam link about said pivot point to operatively move said stop element from said dead bolt engaging position to said released position.

2. An assembly as set forth in claim 1 wherein said trigger means includes an actuator mounted in said housing and reciprocal between an extended position out of said housing and a retracted position within said housing for sensing a strike plate when the door is closed and a trigger hammer having a head portion and being pivotal about a point spaced from said head portion in response to said actuator moving to said retracted position to rotate said cam link about said pivot point to operatively move said stop element from said dead bolt engaging position to said release position.

3. As assembly as set forth in claim 2 wherein said cam link includes a cam means spaced from said pivot point and opposite to said connection to said stop element for engaging said head portion of said trigger hammer when said actuator is moved to said retracted position to operatively rotate said cam link about said pivot point to move said stop element from said dead bolt engaging position to said release position.

4. An assembly as set forth in claim 3 wherein said cam means defines a slot and said head portion of said trigger hammer includes a pin, said pin being slidably disposed within said slot for rotating said cam link about said pivot point in response to said pivotal movement of said trigger hammer, said assembly including hammer biasing means for biasing said trigger hammer into engagement with said actuator to urge said actuator to said extended position, said trigger hammer including a stem portion and said pivot point being disposed on said stem portion.

5. In a mortise lock of the type disposed within a rectangular housing and adapted for mounting in the front edge of a door opposite a strike plate on a door jamb, said rectangular housing having a front plate substantially flush with the front edge of the door and a rear plate spaced rearwardly therefrom with top and bottom plates extending between the front and rear plates, a reciprocal latch bolt movable through an aperture in the front plate between an extended position and a retracted position and latch bolt biasing means continuously biasing the latch bolt to said extended position, a reciprocal dead bolt disposed between the latch bolt and said top plate and movable through an aperture in the front plate between an extended position and a retracted position, and dead bolt biasing means for continuously biasing the dead bolt to said extended position, bolt retractor means for moving said latch bolt and said latch bolt to said retracted positions, and including inner and outer hubs journaled in the side plates between the latch bolt and the bottom plate for independent rotation and each of said hubs including radially disposed roll back surfaces, said retractor means including hub lever means having a retractor portion coacting with said roll back surfaces and movable thereby by rotation of either of said inner or outer hubs, and a lever portion connected with the retractor portion and pivotally movable by movement of the retractor portion to move the latch bolt and the dead bolt to the retracted positions when the inner or outer hubs are rotated, said retractor portion being generally L-shaped and including a side leg, a semi-circular shoe portion including radially disposed arcuate bearing surfaces for contact with said roll back surfaces and a bottom-like portion extending below said hubs for contact with said roll back surfaces, the improvement comprising:

reciprocal trigger means disposed in the front plate below the latch bolt and movable between an extended position and a retracted position for sensing the strike plate when the door is closed and a dead bolt stop means movable between a dead bolt engaged position and a release position for restraining said dead bolt in said retracted position against the biasing force of said dead bolt biasing means, said trigger means being disposed in front of said hubs and operatively moving said dead bolt stop means from said dead bolt engaged position to said dead bolt release position allowing said dead bolt to be moved automatically to said extended position by the biasing force of said dead bolt biasing means when said trigger means senses the strike plate.

6. An assembly as set forth in claim 5 wherein said stop means includes means for restraining said dead bolt in a plurality of predetermined retracted positions, at least one of said positions being less than said fully retracted position of said dead bolt.

7. An assembly as set forth in claim 6 wherein said dead bolt includes a tail piece presenting a flange, said means for restraining said dead bolt includes an incremental stepped portion disposed at one end of said stop element for alternatively engaging said flange on said dead bolt tail piece to restrain said dead bolt in a plurality of predetermined retracted positions at least one of said positions being less than said fully retracted position of said dead bolt.

8. An assembly as set forth in claim 7 wherein said incrementally stepped portion includes a series of ascending stepped notches having an upper most notch disposed nearest to the front plate of said housing to restrain said dead bolt in its least retracted position, and a lowermost notch disposed farthest from the front plate of said housing to restrain said dead bolt in its fully retracted position, and intermediate stepped notches disposed between said uppermost and said lowermost notches for restraining said dead bolt in said plurality of predetermined retracted positions depending upon the distance said dead bolt is retracted.

9. An assembly as set forth in claim 8 wherein said dead bolt stop element is adapted for rectilinear movement between said dead bolt engaging position and said released position in response to said rotation of said cam link about said pivot point, said stop element includes a rectangular plate pivotally connected to said cam link at one end thereof and said incrementally stepped portion disposed at the end opposite to said connection to said cam link, and a slot disposed between said ascending stepped notches and said connection to said cam link and a pin fixedly secured to said housing and extending through said slot to facilitate said rectilinear movement of said stop element, said retractor portion and said lever portion including coacting bearing surfaces which coact in response to the rectilinear movement of said retractor to pivot said lever portion about said pivot point to retract said dead bolt and said latch bolt.

10. An assembly as set forth in claim 9 wherein said latch bolt includes a tail piece projecting rearwardly through a guide slot formed in a boss fixedly mounted to said housing and a tail plate disposed at the distal end of said tail piece and forming an abutment surface thereon, said dead bolt tail piece including a rearwardly extending offset dead bolt tail piece including a slot therein, said dead bolt biasing means including a dead bolt turn piece journaled on said housing and which includes an extending portion disposed within said tail piece slot and a spring receiving depression disposed opposite said extending portion for receiving a spring to rotate said dead bolt turn piece in one direction thereby biasing said dead bolt to said extended position, said lever portion includes a latch bolt retractor flange operatively engaging said abutment surface on said latch bolt tail plate and dead bolt retracting flange operatively engaging said extended portion on said dead bolt turn piece to rotate said dead bolt turn piece in an opposite direction thereby retracting said dead bolt and to move said latch bolt tail piece in a rearwardly direction thereby retracting said latch bolt as said lever portion is pivoted in response to said rectilinear movement of said retractor portion.

11. An assembly as set forth in claim 6 wherein said stop means includes a stop element and a cam link operatively connected to said stop element and rotatable about a pivot point spaced from said connection to said stop element, said trigger means adapted to operatively rotate said cam link about said pivot pint to operatively move said stop element from said dead bolt engaging position to said released position.

* * * * *